United States Patent [19]

Hollier et al.

[11] 4,203,266

[45] May 20, 1980

[54] MAST LEVELING AND SUPPORT APPARATUS

[75] Inventors: Thomas R. Hollier, Vidor; Robert E. Johnson, Beaumont, both of Tex.

[73] Assignee: Dresser Industries, Inc., Dallas, Tex.

[21] Appl. No.: 860,668

[22] Filed: Dec. 15, 1977

[51] Int. Cl.[2] ..... E04H 12/34

[52] U.S. Cl. ..... 52/116; 173/43

[58] Field of Search ..... 52/116, 119; 173/42, 173/43, 44; 248/23

[56] References Cited

U.S. PATENT DOCUMENTS

| | | | |
|---|---|---|---|
| 1,571,077 | 1/1926 | Washa | 173/42 X |
| 2,990,859 | 7/1961 | Ruben | 248/23 X |
| 3,833,195 | 9/1974 | Anton | 248/23 X |
| 3,850,253 | 11/1974 | Lupton et al. | 173/44 X |
| 3,992,831 | 11/1976 | Bukovitz et al. | 52/116 |
| 4,022,284 | 5/1977 | Crow | 173/2 |

*Primary Examiner*—Price C. Faw, Jr.

*Assistant Examiner*—Carl D. Friedman

*Attorney, Agent, or Firm*—Richard M. Byron

[57] ABSTRACT

A box-like platform having a mast leveling hinge support anchored thereto and a mast structure pivotally attached to the upper end of the hinge support is pivotally attached at one of its ends to an elongated skid unit. The opposite end of the platform is arranged to be raised or lowered by a pair of jacking assemblies connected to the skid unit to effect leveling of the platform. A hydraulic ram having one end connected to the mast and the other end connected to a ram beam supported by a lower extension of the platform enables the mast to be raised to its upright position. By utilizing the ram in conjunction with the leveling characteristic of the platform, the mast assembly can thus be raised to a level and stable condition without the skid unit being perfectly level with respect to the earth's surface. The apparatus permits proper alignment of the mast to the center line of the well to compensate for settlement of the skid unit on an unlevel foundation.

4 Claims, 5 Drawing Figures

MAST LEVELING AND SUPPORT APPARATUS

BACKGROUND OF THE INVENTION

The present invention relates to apparatus for drilling or otherwise working with earth boreholes, and in particular, to apparatus for aligning mast on skid units for such operations.

The prior art has long recognized that skid units or other such foundations used for supporting mast assemblies are difficult to level when first erecting the mast and also that such skid units can settle at one end or the other because of the very heavy weight involved and thus create problems in proper alignment of the mast with regard to the center line of the well. Those in the prior art have attempted to correct this problem by leveling or otherwise aligning the mast by means of jacks and shim plates. Those in the prior art would also, from time to time, jack the complete rig to control the front and rear, side-to-side movement of the mast to the center light of the well.

It is therefore the primary object of the present invention to provide a new and improved apparatus for leveling and otherwise aligning the mast with substantially no effect on the remainder of the rig; and It is also an object of the invention to provide a new and improved apparatus which eliminates the jacking of the complete rig to control the front and rear, side-to-side movement of the mast to the center line of the well.

The objects of the present invention are accomplished, generally, by the use of a box-like platform wherein one end of the platform is pivotally attached to the skid unit and the other side of the platform is adjustable with respect to the skid unit. A ram connected between the mast and the platform, in conjuction with the pivoting action of the platform with respect to the skid, enables the mast, anchored to the platform, to be aligned as desired with respect to the center line of the well.

These and other objects, features and advantages of the present invention will be more readily appreciated from a reading of the following detailed specification and drawing, in which.

Figure 1:
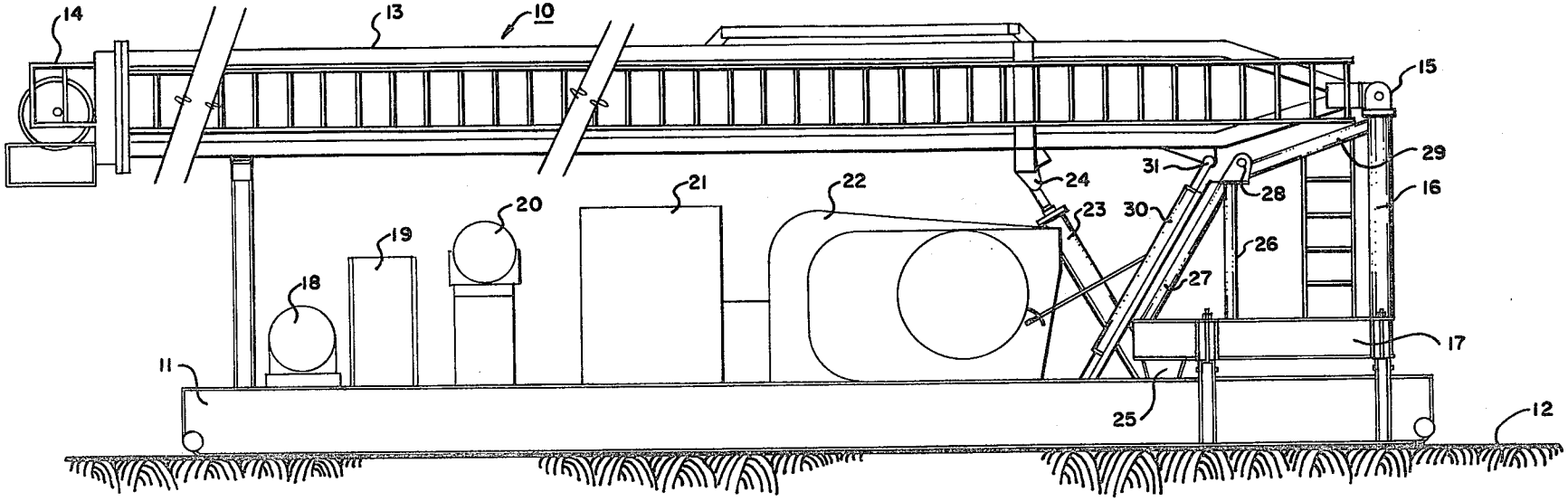
FIG. 1 is a side elevational view of the apparatus in accordance with the present invention.

Referring now to the drawing in more detail, especially to FIG. 1, there is illustrated a drilling rig assembly 10 in accordance with the present invention. The drilling rig assembly 10 includes a skid unit 11 which is illustrated in position on the earth's surface 12. A pivotable drilling mast 13 has a crown block assembly 14 at its one end and is pivoted at its other end around an axis 15 at the upper end of the mast leveling hinge support 16. The lower end of the mast leveling hinge support 16 is securely anchored to a box-like platform 17.

The skid unit 11 includes a fuel tank 18, a housing 19 for the hydraulic tank and controls for the mast, a water tank 20, an engine and torque converter 21, and a hoist unit 22.

Figure 5:
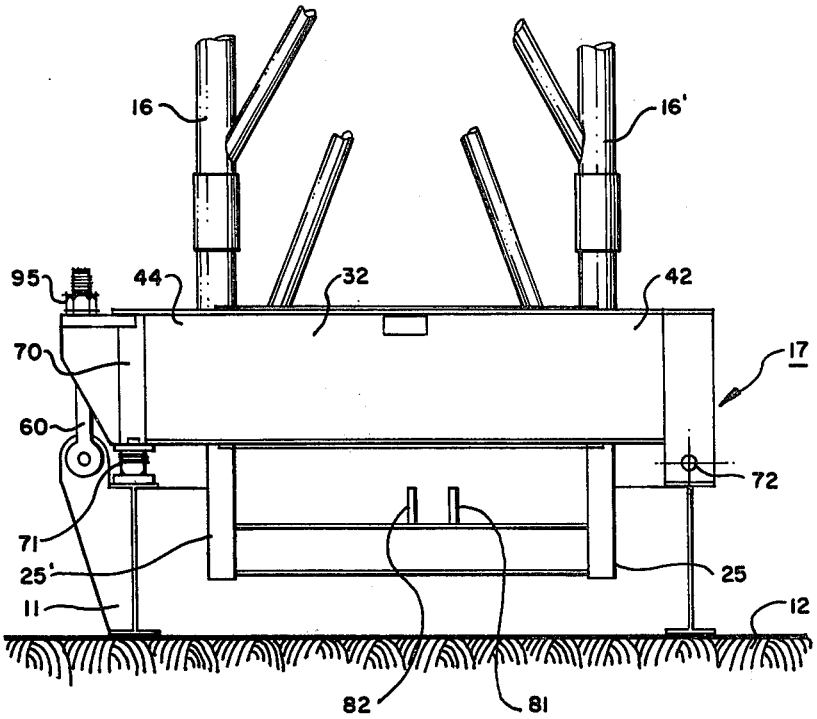
FIG. 5 is an end elevational view of the platform in relationship to the skid unit.

A ram unit 23 which is utilized for raising the mast 13 is connected at point 24 on the mast 13 and at its lower end to a ram beam connected betweeen a pair of lower extension members 25 and 25' connected to the platform 17, the ram beam being illustrated in FIG. 5. The mast is further stabilized by support arms 26 and 27 which at their upper ends are connected to a junction 28. An additional support arm 29 is connected between conjunction 28 and the upper end of the mast leveling hinge support member 16.

An additional support member 30, pivoted at its upper end 31 to the mast 13, slides within a slot (not illustrated) in the support member 27 as the mast is raised. Although not illustrated, the support arm 30 has a connection point at its lower end which is pinned to the junction 28 by one of the rig operators whenever the mast is in its raised position, thus providing additional structural strength to the mast assembly.

In the operation of the system 10 illustrated in FIG. 1, it should be appreciated that the skid unit 11 is first transported to the location and then placed on the earth's surface 12 in preparation for the raising of the mast 13. With prior art systems, the usual procedure consisted of leveling the mast by means of jacks and shim plates. With such procedures, the rig was generally considered to be in an unstable situation. Even with ground which is substantially level, there is nonetheless some unevenness of the ground under the best of conditions and frequently the skid unit 11 will tend to settle at one end or the other and again create an unlevel foundation for the mast.

In the operation of the system illustrated in FIG. 1, however, the ram 23 is used to raise the mast and once the mast is in an upright position, the support member 30 is pinned at the junction 28. Thus, the operation of the ram 23 causes the mast 13 to pivot around the pivot point 15 to provide the proper alignment of the mast in the plane of the drawing of FIG. 1. As will be explained in more detail hereinafter, the platform 17 is pivoted in the plane perpendicular to the plane of the drawing of FIG. 1 to provide leveling of the mast in accordance with the invention.

Figure 2:
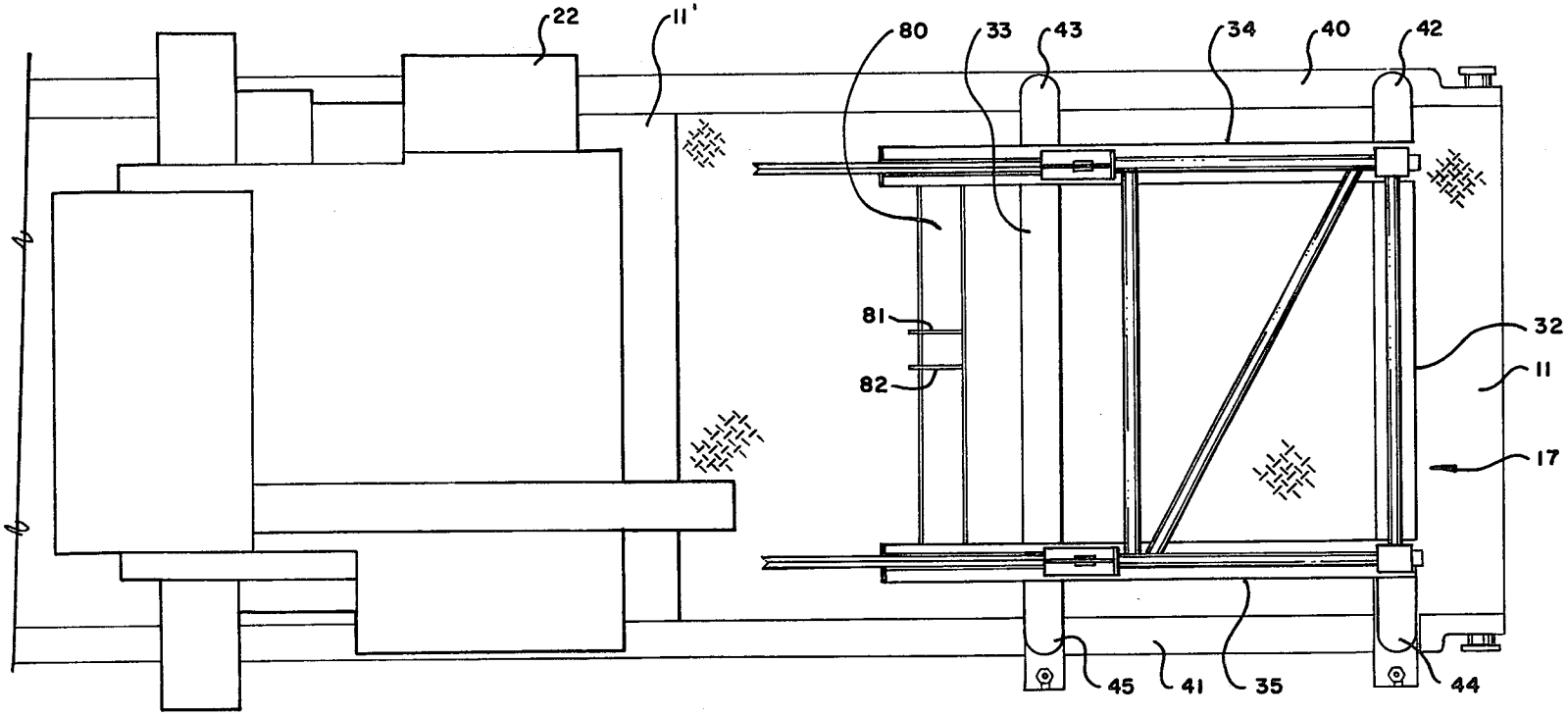
FIG. 2 is a top plan, cutaway view, partly in block diagram, of the platform in relationship to the skid unit.

Referring now to FIG. 2, a top plan, cutaway view of the skid unit 11 is illustrated with respect to the platform 17. The platform 17 is a box-like structure comprised of four beams, viz., the parallel beams 32 and 33 and the parallel beams 34 and 35. The hoist unit 22 is illustrated in block diagram merely to show its relationship to that of the platform 17 on the skid unit 11. The skid unit 11 has a pair of parallel beams 40 and 41 partially covered over by a plate 11'. The parallel beams 32 and 33 of the platform 17 are pivotally attached to their ends 42 and 43, respectively, to the beam 40 of the skid unit 11. The ends 44 and 45 of the parallel beams 32 and 33, respectively, are movably attached to the parallel beam 41 of the skid unit 11 as will be explained in more detail hereinafter. A ram beam 80, having a pair of upper extensions 81 and 82, is supported by the lower extensions 25 and 25', illustrated in greater detail in FIG. 5.

Figure 3:
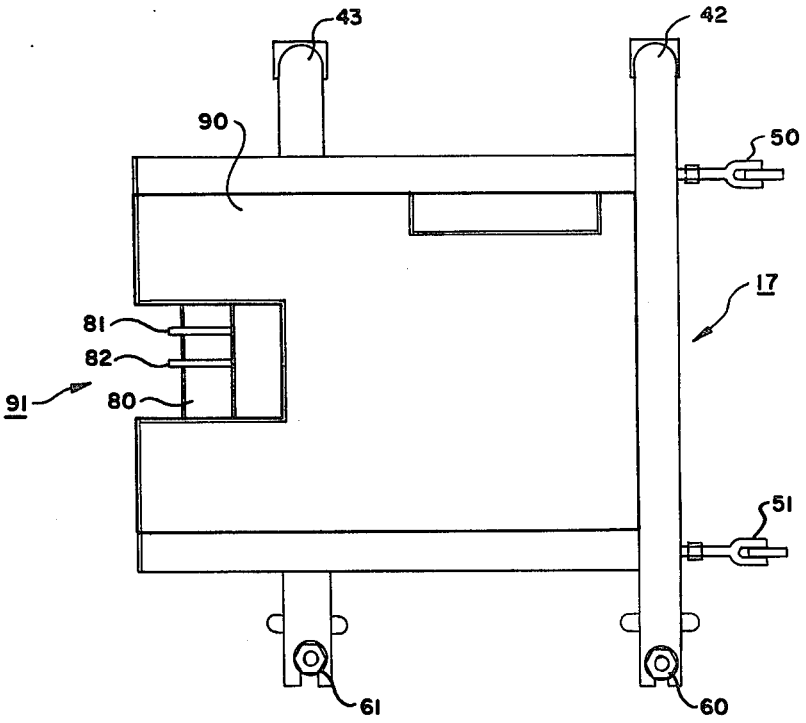
FIG. 3 is a top plan view of a portion of the box-like platform in accordance with the present invention.
Figure 4:
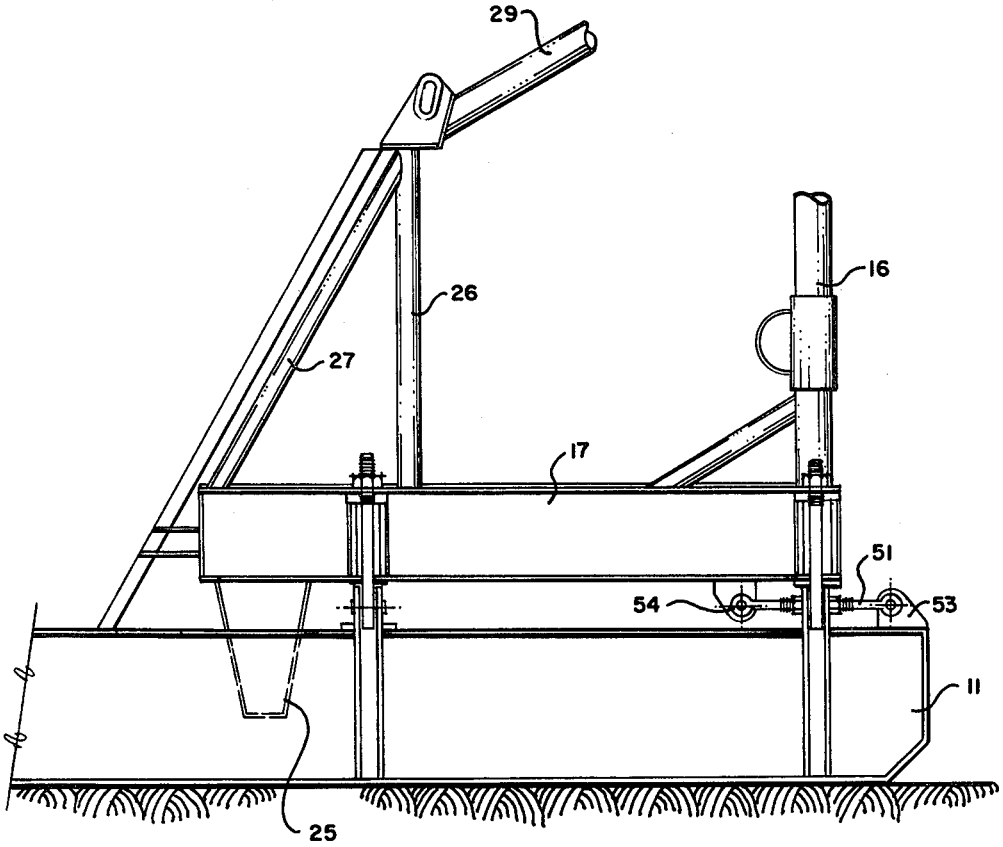
FIG. 4 is an expanded side elevational view of the platform shown in relationship to the skid unit.

Referring now to FIG. 3, there is illustrated another top plan view of the platform 17 which is somewhat like the drawing of FIG. 2 except for the added floor 90 having an opening 91 for attaching the ram 23 and for not showing the various support arms. A pair of turnbuckles 50 and 51, one of which is illustrated in more detail in FIG. 4, are used to provide additional support as the mast is being raised. As was previously mentioned with respect to FIG. 1, the ram member 23 is pivotally connected at its lower end of the upper extension member 82 on the ram beam 80, the upper extension member 81 being used for a safety line or other such connection. A pair of safety bolts 60 and 61, one of which is shown in greater detail in FIG. 5, are utilized for holding the platform in place after the leveling procedure is followed.

Referring now to FIG. 4, the platform 17 and its relationship to the skid unit 11 is shown in somewhat more detail. The turnbuckle 51 is anchored between a pivot point 53 on the skid unit 11 and a pivot point 54 on the lower side of the platform 17. As previously mentioned, these turnbuckles provide additional supportive measures when the mast is being raised to its uppermost position.

Referring now to FIG. 5, an end view of the platform 17 is shown in its positional relationship with regard to the skid unit 11. A safety bolt 60, one end of which is anchored to the skid unit 11, passes through an opening in the outer end of the beam 32. The end 44 of the beam 32 has a jack tube 70 therethrough into which a screw jack 71 anchored to the skid unit 11 is inserted. The other end 42 of the beam 32 is pivotally attached to the skid unit 11 at the pivot point 72.

In the operation of the apparatus illustrated in FIG. 5, taken in conjunction with the overall apparatus as illustrated in FIG. 1, after the ram 23 is used to raise the mast 13 to its upright position, the screw jack 71 is then manipulated as necessary to cause the platform 17 to pivot around the pivot point 72. Because of the great height of the mast, one or two inches movement of the platform 17 causes several feet of movement at the upper end of the mast. After the platform 17 is leveled, the nut 95 is screwed onto the safety bolt 60 to secure the mast in the level position desired. Although not illustrated in FIG. 5, the platform 17 has two such pivot points and two such screw jack assemblies along with the two safety bolts 60 and 61.

Since the mast leveling hinge supports 16 and 16' are anchored to the platform 17, the leveling of the platform 17 thus causes the mast 13 to be positioned as desired.

Thus there has been illustrated and described herein the preferred embodiment of the present invention wherein the skid unit itself is allowed to remain on the earth's surface without attempting to level any portion of it and only the small platform structure 17 is leveled to cause the mast itself to be leveled. However, obvious modifications to the preferred embodiment will occur to those skilled in the art after a reading of the foregoing detailed specification and drawing. For example, hydraulic jacks may be used instead of the screw jacks illustrated in the preferred embodiment. Likewise, a single jack may be used to cause the platform 17 to pivot around the pivot points if desired, and in a similar manner, instead of using a plurality of pivot points for the platform 17, a single such pivot point may be used.

The embodiments of the invention in which an exclusive property or privilege is claimed are defined as follows:

1. An apparatus for aligning a mast assembly used with earth boreholes, comprising:

a skid unit;

a platform having first and second opposing end portions, the first said end portion being pivotally attached to said skid unit to pivot about an axis lying along one side of said skid unit and the second said end portion being movable with respect to said skid unit;

a hinged mast attached to said platform to pivot about an axis generally perpendicular to the pivotal axis of said platform and said skid unit and being adapted to be pivoted for raising to an erect position for use with respect to said platform;

means attached between said mast and said platform for raising said mast;

means for causing said platform to pivot with respect to said skid unit including an upwardly facing shoulder on an upper surface portion of said skid unit;

a downwardly facing shoulder on a lower surface portion of said platform substantially vertically positioned above said skid unit upwardly facing shoulder;

a jack screw mounted between said shoulders and operable to control the minimum distance between said shoulders and thereby effect pivoting of said platform relative to said skid unit; and means, independent of said means for causing said platform to pivot, to rigidly secure said platform from pivotal motion relative to said skid unit including an upwardly facing surface portion on said platform having an opening therethrough and an upwardly facing shoulder around said openings;

a bolt mounted with said skid unit and extending upwardly through said opening; and a nut threadedly mounted on the upper end portion of said bolt and engaged with said platform upwardly facing shoulder and thereby operable to limit pivoting movement of said platform away from said skid unit and secure said platform in place against said jack screw.

2. An apparatus for aligning a mast assembly used in the drilling of earth boreholes, comprising:

a skid unit;

a platform having first and second opposing end portions, the first said end portion being pivotally attached to said skid unit to pivot about an axis lying along one side of said skid unit and the second said end being movable with respect to said skid unit;

a hinged mast attached to said platform and being adapted to be raised with respect to said platform by pivoting about axis that is generally perpendicular to the pivotal axis of said skid unit and said platform;

a ram attached between said mast and said platform for raising said mast;

means for causing said platform to pivot with respect to said skid unit including an upwardly facing shoulder on an upper surface portion of said skid unit;

a downwardly facing shoulder on a lower surface portion of said platform substantially vertically positioned above said skid unit upwardly facing shoulder;

a jack screw mounted between said shoulders and operable to control the minimum distance between said shoulders and thereby effect pivoting of said platform relative to said skid unit; and means, independent of said means for causing said platform to pivot, to rigidly secure said platform from pivotal motion relative to said skid unit including an upwardly facing surface portion on said platform having an opening therethrough and an upwardly facing shoulder around said opening;

a bolt mounted with said skid unit and extending upwardly through said opening; and a nut threadedly mounted on the upper end portion of said bolt and engaged with said platform upwardly facing shoulder and thereby operable to limit pivoting movement of said platform away from said skid unit and secure said platform in place against said jack screw.

3. An apparatus for aligning a mast assembly used in the drilling of earth boreholes, comprising:

a skid unit;

a platform having first and second opposing end portions, the first said end portion being pivotally attached to said skid unit to pivot about an axis lying along one side of said skid unit and the second said end portion being movable with respect to said skid unit;

a hinged mast attached to said platform to pivot about an axis generally perpendicular to the pivotal axis of said platform and said skid unit and being adapted to be raised with respect to said platform;

a ram attached between said mast and said platform for raising said mast;

jacking means connected between the second end portion of said platform and said skid unit for causing said platform to pivot with respect to said skid unit including an upwardly facing shoulder on an upper surface portion of said skid unit;

a downwardly facing shoulder on a lower surface portion of said platform substantially vertically positioned above said skid unit upwardly facing shoulder;

a jack screw mounted between said shoulders and operable to control the minimum distance between said shoulders and thereby effect pivoting of said platform relative to said skid unit; and safety anchor means independent of said jacking means and joining said platform and said skid unit to rigidly secure said platform from pivotal motion relative to said skid unit once said platform has been appropriately positioned including an upwardly facing surface portion on said platform having an opening therethrough and an upwardly facing shoulder around said opening;

a bolt mounted with said skid unit and extending upwardly through said opening; and a nut threadedly mounted on the upper end portion of said bolt and engaged with said platform upwardly facing shoulder and thereby operable to limit pivoting mvoement of said platform away from said skid unit and secure said platform in place against said jack screw.

4. An apparatus for aligning a mast assembly used in the drilling of earth boreholes, comprising:

a skid unit;

a platform having first and second opposing end portions, the first said end portion being pivotally attached to said skid unit to pivot about one side of said skid unit and the second said end portion being movable with respect to said skid unit;

a hinged mast attached to said platform to pivot generally perpendicular to the pivot of said platform and said skid unit and being adapted to be raised with respect to said platform;

means for raising said mast;

means for causing said platform to pivot with respect to said skid unit including an upwardly facing shoulder on an upper surface portion of said skid unit;

a downwardly facing shoulder on a lower surface portion of said platform substantially vertically positioned above said skid unit upwardly facing shoulder;

a jack screw mounted between said shoulders and operable to control the minimum distance between said shoulders and thereby effect pivoting of said platform relative to said skid unit; and means, separate from said means for causing said platform to pivot, joining said platform and said skid unit to secure pivoting motion of said platform relative to said skid unit including an upwardly facing surface portion on said platform having an opening therethrough and an upwardly facing shoulder around said opening;

a bolt mounted with said skid unit and extending upwardly through said opening; and a nut threadedly mounted on the upper end portion of said bolt and engaged with said platform upwardly facing shoulder and thereby operable to limit pivoting movement of said platform away from said skid unit and secure said platform in place against said jack screw.

* * * * *